US005089174A

United States Patent [19]

Kaw et al.

[11] Patent Number: 5,089,174

[45] Date of Patent: Feb. 18, 1992

[54] LAUNDRY DETERGENT BARS FREE OF $C_{12}$–$C_{18}$ FATTY ACIDS AND CONTAINING AN ALKYLBENZENE SULFONATE, AN ALKYL SULFONATE AND A FATTY ALCOHOL

[75] Inventors: James U. Kaw, Taipei, Taiwan; Laurie B. Steuri, Oxshott, United Kingdom

[73] Assignee: The Procter & Gamble Company, Cincinnati, Ohio

[21] Appl. No.: 562,066

[22] Filed: Aug. 2, 1990

Related U.S. Application Data

[63] Continuation-in-part of Ser. No. 299,367, Jan. 19, 1989, abandoned.

[51] Int. Cl.[5] ..... C11D 1/22

[52] U.S. Cl. ..... 252/553; 252/549; 252/534; 252/538; 252/558; 252/DIG. 16

[58] Field of Search ..... 252/534, 538, 553, 558, 252/DIG. 16, 549

[56] References Cited

U.S. PATENT DOCUMENTS

| | | | |
|---|---|---|---|
| 2,941,948 | 10/1956 | Blinka et al. | 252/138 |
| 2,972,583 | 2/1961 | Hewitt | 252/161 |
| 2,982,735 | 5/1961 | Blinka et al. | 252/121 |
| 3,024,197 | 3/1962 | Dohr et al. | 252/117 |
| 3,291,744 | 12/1966 | Bohrer | 252/161 |
| 3,481,880 | 12/1969 | Austin et al. | 252/138 |
| 3,708,425 | 1/1973 | Compa et al. | 252/89 |
| 4,234,464 | 11/1980 | Morshauser | 252/544 |
| 4,476,046 | 10/1984 | Wong et al. | 252/550 |
| 4,543,204 | 9/1985 | Gervasio | 252/531 |
| 4,705,644 | 11/1987 | Barone et al. | 252/132 |

FOREIGN PATENT DOCUMENTS

| | | |
|---|---|---|
| 1191722 | 5/1970 | United Kingdom . |
| 2048931 | 12/1980 | United Kingdom . |
| 2060676 | 5/1981 | United Kingdom . |
| 1294754 | 11/1987 | United Kingdom . |

*Primary Examiner*—Paul Lieberman
*Assistant Examiner*—Bradley A. Swope
*Attorney, Agent, or Firm*—Daniel F. Nesbitt; Gary M. Sutter; Richard C. Witte

[57] ABSTRACT

The laundry detergent bars of the present invention comprise from about 10% to about 60% by weight anionic surfactant, from about 5% to about 60% by weight detergent builder, and from about 0.75% to about 10% by weight fatty alcohol having an alkyl chain containing from 10 to 22 carbon atoms, wherein the anionic surfactant comprises alkylbenzene sulfonate having a linear or branched alkyl chain, or mixture thereof of from 10 to 22 carbons atoms, and alkyl sulfate having an alkyl chain of from 10 to 20 carbon atoms, where the weight ratio of alkylbenzene sulfonate surfactant to alkyl sulfate surfactant is from 9:1 to 1:9. The laundry detergent bars are substantially free of fatty acid. By "substantially free of fatty acid" is meant less than about 1% of $C_{12}$–$C_{18}$ fatty acid.

13 Claims, No Drawings

LAUNDRY DETERGENT BARS FREE OF $C_{12}$–$C_{18}$ FATTY ACIDS AND CONTAINING AN ALKYLBENZENE SULFONATE, AN ALKYL SULFONATE AND A FATTY ALCOHOL

This is a continuation-in-part of our copending application, Ser. No. 07/299,367, filed Jan. 19, 1989, for IMPROVED LAUNDRY DETERGENT BARS.

BACKGROUND OF THE INVENTION

The invention relates to improved laundry detergent bars. More particularly, it relates to laundry detergent bars comprising a mixture of anionic surfactants comprising alkylbenzene sulfonate and alkyl sulfate, detergent builders, and fatty alcohol, and which are substantially free of fatty acid. The bars exhibit improved bar wear rate and smear.

Detergent compositions in the form of synthetic detergent granules and liquids are used in many societies to launder clothes, particularly in those societies where mechanical washing machines are common. In portions of such societies, and more frequently in societies where mechanical washing machines are not common, laundry detergent bars comprising synthetic organic surfactants and detergency builders are used in the laundering of clothes.

Technical developments in the field of laundry detergent bars have concerned formulating bars which are effective in cleaning clothes; which have acceptable sudsing characteristics in warm and cool water and in hard and soft water; which have acceptable in-use wear rates, hardness, durability, and feel; which have low smear; and which have a pleasing odor and appearance. U.S. Pat. No. 3,178,370 (issued to Okenfuss on Apr. 13, 1965 and incorporated herein by reference) describes laundry detergent bars comprising sodium alkylbenzene sulfonate (ABS), sodium tripolyphosphate, sodium bicarbonate, trisodium orthophosphate, and water, and processes for making these. Philippine Patent 13,778 (issued to Anderson on Sept. 23, 1980) describes synthetic detergent laundry bars containing surfactant, alkali metal pyrophosphate, from about 18% to about 60% alkaline earth metal carbonate, and from about 1% to about 20% water. Methods for making laundry detergent bars are well known in the art.

Although alkylbenzene sulfonate surfactants, such as sodium dodecylbenzene sulfonate, have been used to make satisfactory detergent laundry bars, such surfactants are derived from non-renewable petroleum-based raw materials. Accordingly, efforts have been made to formulate detergent laundry bars containing synthetic organic surfactants derived from natural sources. One such surfactant is higher fatty alkyl sulfate (AS), especially the alkali metal salt. However, use of higher fatty alkyl sulfate as a total replacement for alkylbenzene sulfonate does not produce a laundry bar with the same commercial acceptability as one made wholly from alkylbenzene sulfonate. Specifically, bars made with alkyl sulfate are more brittle and susceptible to breakage during ordinary shipment. U.S. Pat. No. 4,543,204 (issued to Gervasio on Sept. 24, 1985) discloses laundry detergent bars comprising 10 to 35% of higher fatty alkyl sulfate, and from 1 to 10% of higher fatty acid which makes the bars more resistant to breaking on handling and storage.

The consumer evaluates the performance of a laundry detergent bar against many factors, including cleaning, bar aesthetics, and the value of the detergent bar. Bar value can be diminished when the bar wears excessively during use. In use, the bar wears by abrasion of the bar while laundering the clothes and by dissolving away of the bar in the wash water. This wear can be aggravated while the bar is being stored on the wash stand between washings. On the wash stand, the bar typically lies in a puddle of water. The bar surface submerged in the water becomes gel-like as water is absorbed. This gel-like bar material wears away readily. Handling of the bar also becomes very messy.

The object of the present invention is to improve the properties of detergent bars comprising a mixture of ABS and AS by incorporating fatty alcohol into the bar. Such bars have reduced bar wear and solubility, while maintaining good cleaning and bar aesthetics.

DETAILED DESCRIPTION OF THE INVENTION

While this specification concludes with claims distinctly pointing out and particularly claiming that which is regarded as the invention, it is believed that the invention can be better understood through a careful reading of the following detailed description of the invention. In this specification all percentages are by weight, all temperatures are expressed in degrees Celsius, and the decimal is represented by the point (.), unless otherwise indicated.

The laundry detergent bars of the present invention comprise from about 10% to about 60% by weight anionic surfactant, from about 5% to about 60% by weight detergent builder, and from about 0.75% to about 10% by weight fatty alcohol having an alkyl chain containing from 10 to 22 carbon atoms, wherein the anionic surfactant comprises alkylbenzene sulfonate having a linear or branched alkyl chain, or mixture thereof, of from 10 to 22 carbons atoms, and alkyl sulfate having an alkyl chain of from 10 to 20 carbon atoms, where the weight ratio of alkylbenzene sulfonate surfactant to alkyl sulfate surfactant is from 9:1 to 1:9. The laundry detergent bars are substantially free of fatty acid. By "substantially free of fatty acid" is meant less than about 1% of $C_{12}$–$C_{18}$ fatty acid.

Preferred bars comprise about 20% to about 40%, more preferably from about 25% to about 35%, anionic surfactant. Preferably, the anionic surfactant comprises (a) alkylbenzene sulfonate, and (b) alkyl sulfate at weight ratios of (a):(b) from about 1:4 to about 6:1, more preferably from about 1:2.0 to about 2.5:1.

The alkyl portion of the alkyl sulfate surfactant preferably contains from 10 to 18 carbon atoms, more preferably from 12 to 16 carbon atoms. The alkyl portion of the alkylbenzene sulfonate surfactant preferably contains from 10 to 16 carbon atoms, more preferably from 11 to 13 carbon atoms, and is preferably branched chain. The cation for the alkylbenzene sulfonate and for the alkyl sulfate is preferably sodium, although other useful cations include triethanolamine, potassium, ammonium, magnesium, and calcium, or mixtures thereof.

The bars of the present invention comprise from about 5% to about 60% by weight detergent builder. Preferred laundry bars comprise from about 5% to about 20% builder, more preferably from about 7% to about 15%, by weight of the bar. These detergent builders can be, for example, water-soluble alkali-metal salts of phosphates, pyrophosphates, orthophosphates, tripolyphosphates, and higher polyphosphates, and mixtures thereof. Specific preferred examples of builders include sodium tripolyphosphates (STPP) and sodium pyrophosphates (TSPP), and mixtures thereof.

A principal component of the present laundry detergent bar is fatty alcohol. Preferred laundry bars comprise from about 2% to about 6%, more preferably from about 3% to about 5%, fatty alcohol by weight of the bar. The fatty alcohol preferably has an alkyl chain containing from 12 to 18 carbon atoms, more preferably from 16 to 18 carbon atoms. The fatty alcohol may be obtained from natural sources, such as a coconut oil and palm oil, or may be synthesized, as from petroleum products.

Absent the addition of fatty alcohol, a built laundry detergent bar utilizing a mixture of AS and ABS has poorer bar wear rate and solubility properties relative to bars made wholly with either ABS or AS surfactant. Substitution of as little as 20% of the ABS surfactant of an all-ABS bar with AS surfactant deteriorates the quality of the bar significantly, with an increase in bar wear rate and bar smear. As substitution of AS increases towards 60% of the ABS surfactant, the bar properties do not further change importantly.

Fatty alcohol is effective at reducing the bar wear rate and smear (mushiness) of the present laundry bars. For a given bar composition, an increase in fatty alcohol level improves these bar properties (lowers bar wear rate and lowers smear). Generally, for higher usage of anionic surfactant in the bar, higher levels of fatty alcohol are needed to improve bar properties to an acceptable level. Likewise, for higher proportions of alkyl sulfate to alkylbenzene sulfonate in the anionic surfactant portion, higher levels of fatty alcohol are needed to improve bar properties to an acceptable level.

The use of broad-cut ($C_{10}$–$C_{18}$) fatty alcohol may produce a fatty odor attributable to the low cut ($C_{10}$–$C_{14}$) fatty alcohol. For this reason, fatty alcohol with an alkyl chain predominantly containing from 16 to 18 carbon atoms, so-called "high-cut fatty alcohol," is preferred as it exhibits less base odor of fatty alcohol relative to broad cut fatty alcohols.

The fatty alcohol is generally added to the formulation of the present invention as free fatty alcohol. However, low levels of fatty alcohol can be introduced into the bars as impurities or as unreacted starting material. For example, laundry bars based on coconut fatty alkyl sulfate can contain, as unreacted starting material from 0.1% to 3.5%, more typically from 2% to 3%, by weight of free coconut fatty alcohol on a coconut fatty alkyl sulfate basis. Fatty alcohol can also be introduced into the formulation by permitting the alkyl sulfate to undergo acid-catalyzed reversion to the conjugate fatty alcohol.

OPTIONAL COMPONENTS

The detergent bars of the present invention can contain up to about 70% by weight of optional ingredients commonly used in detergent products. A typical listing of the classes and species of optional surfactants, optional builders and other ingredients useful herein appears in U.S. Pat. No. 3,664,961 (issued to Norris on May 23, 1972), incorporated herein by reference. The following are representative of such materials, but are not intended to be limiting.

Water-soluble salts of the higher fatty acids (i.e., "soaps") are useful as auxiliary surfactants in the present composition. This class of surfactants includes ordinary soaps such as the sodium, potassium, ammonium and alkanolammonium salts of higher fatty acids. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Other optional anionic surfactants useful herein as auxiliary surfactants include sodium alkyl glyceryl ether sulfates, especially those ethers of higher alcohols derived from tallow and coconut oil; sodium coconut oil fatty acid monoglyceride sulfonates and sulfates; sodium or potassium salts of alkyl phenol ethylene oxide ether sulfates, and sodium or potassium salts of methyl ester sulfonates.

Water-soluble nonionic synthetic surfactants are also useful as auxiliary surfactants in the present composition. Such nonionic surfactants can be broadly defined as compounds produced by the condensation of ethylene oxide groups (hydrophilic in nature) with an organic hydrophobic compound, which may be aliphatic or alkyl aromatic in nature. The length of the polyoxyethylene group which is condensed with any particular hydrophobic group can be readily adjusted to yield a water-soluble compound having the desired degree of balance between hydrophilic and hydrophobic elements.

Semi-polar nonionic surfactants useful herein as auxiliary surfactants include water-soluble amine oxides; water-soluble phosphine oxide surfactants; and water-soluble sulfoxide surfactants.

Also useful as auxiliary surfactants are ampholytic surfactants which include aliphatic derivatives of heterocyclic secondary and tertiary amines; zwitteriohnic surfactants which include derivatives of aliphatic quaternary ammonium, phosphonium and sulfonium compounds; water-soluble salts of esters of alpha-sulfonated fatty acids; alkyl ether sulfates; water-soluble salts of olefin sulfonates; and beta-alkyloxy alkane sulfonates.

It is to be recognized that any of the foregoing auxiliary surfactants can be used separately herein, or in mixtures of surfactants, at levels of from about 3% to about 30% by weight of the detergent bar.

In addition to the auxiliary surfactants mentioned above, a hydrotrope, or mixture of hydrotropes, can be present in the laundry detergent bar. Preferred hydrotropes include the alkali metal, preferably sodium, salts of tolune sulfonate, xylene sulfonate, cumene sulfonate, sulfosuccinate, and mixtures thereof. Preferably, the hydrotrope, in either the acid form or the salt form, and being substantially anhydrous, is added to the linear alkyl benzene sulfonic acid prior to its neutralization. The hydrotrope is preferably present at from about 1% to about 5% of the laundry detergent bar.

Materials which do not contain phosphorus can also be selected for use herein as detergency builders. Specific examples of nonphosphorus, inorganic detergency builders include water-soluble inorganic carbonate and bicarbonat salts. The alkali metal (e.g., sodium and potassium) carbonates, bicarbonates, and silicates are particularly useful herein. Also useful are aluminosilicate ion exchange materials. These aluminosilicates can be crystalline or amorphous in structure and can be either naturally occurring or synthetically derived. Preferred synthetic crystalline aluminosilicate ion exchange materials useful herein are available under the designations Zeolite A, Zeolite B, and Zeolite X. In an especially preferred embodiment, the crystalline aluminosilicate ion exchange material is Zeolite A and has the formula:

$Na_{12}[(AlO_2)_{12}.(SiO_2)_{12}].xH_2O$ wherein x is from about 20 to about 30, especially about 27.

Water-soluble organic detergency builders, for example alkali metal, ammonium and substituted ammonium polycarboxylates, are also useful herein. Specific examples of useful polycarboxylate builder salts include sodium, potassium, ammonium and substituted ammonium salts of ethylenediaminetetraacetic acid, nitrilotriacetic acid, oxydisuccinic acid, mellitic acid, benzene polycarboxylic acid, polyacrylic acid, polymaleic acid, and citric acid. Other useful. polycarboxylate detergency builders are the materials set forth in U.S. Pat. No. 3,308,067 issued to Diehl on Mar. 7, 1967, incorporated herein by reference.

Mixtures of detergent builders can be used in the present invention.

Another useful optional component of the laundry detergent bars of this invention is silicate, especially sodium silicate. Sodium silicate can be used at up to about 15% silicate solids having a weight ratio of $SiO_2$ to $Na_2O$ between about 1.6:1 and about 3.4:1.

Sodium sulfate is a well-known filler that is compatible with the compositions of this invention. It can be a by-product of the surfactant sulfation and sulfonation processes, or it can be added separately.

Other optional ingredients include soil suspending agents such as water-soluble salts of carboxymethylcellulose and carboxyhydroxymethylcellulose; polyethylene glycols having a molecular weight of about 400 to 10,000; and dyes, pigments, optical brighteners, germicides, and perfumes.

The detergent laundry bars of the present invention can be processed in conventional soap or detergent bar making equipment with the following key equipment: blender/mixer, mill or ribbon plodder, two-stage vacuum plodder, logo printer/cutter, cooling tunnel and wrapper.

The raw materials are mixed in the blender. Linear or branched alkylbenzene sulfonic acid is added into a mixture of alkaline inorganic salts and the resulting partially neutralized mixture is mechanically worked to effect homogeneity and complete neutralization of the mixture. Once the neutralization reaction is completed, the alkyl sulfate surfactant is added, followed by the free fatty alcohol and the remaining other raw materials. The mixing may take from 1 minute to 1 hour, with the usual mixing time being from 2 to 20 minutes. The blender mix is discharged to a surge tank. The product is conveyed from the surge tank to the mill or ribbon plodder via a multi-worn transfer conveyor.

After milling or preliminary plodding, the product is then conveyed to a double stage vacuum plodder, operating at a high vacuum, e.g. 600 to 740 millimeters of mercury vacuum, so that entrapped air is removed. The product is extruded and cut to the desired bar length, and printed with the product brand name. The printed bar is cooled in a cooling tunnel before it is wrapped, cased, and sent to storage.

Examples of bars of the present invention made by the above method are listed hereafter by way of exemplification, and not by way of limitation, along with representative prior art examples which are postscripted with "R".

EXAMPLES

| | EXAMPLES | | | |
|---|---|---|---|---|
| | 1R | 2 | 3 | 4 |
| BRANCHED $C_{12.1}$ ALKYLBENZENE SULFONATE | 12 | 12 | 12 | 20 |
| COCONUT ALKYL SULFATE | 18 | 18 | 18 | 10 |
| FREE COCONUT FATTY ALCOHOL ($C_{12}$–$c_{18}$) | 0 | 2 | 5 | 0 |
| FREE FATTY ALCOHOL ($C_{16}$) | 0 | 0 | 0 | 3 |
| SODIUM PYROPHOSPHATE | 10 | 10 | 10 | 10 |
| SODIUM CARBONATE | 20 | 20 | 20 | 20 |
| SODIUM SULFATE | 30 | 30 | 20 | 20 |
| CALCIUM CARBONATE | 4 | 2 | 9 | 12 |
| WATER | 3 | 3 | 3 | 3 |
| TITANIUM DIOXIDE | 1 | 1 | 1 | 1 |
| OTHERS* | 2 | 2 | 2 | 1 |
| | 100% | 100% | 100% | 100% |
| BAR PROPERTIES | | | | |
| SMEAR (GRAMS LOSS) | 8.5 | 6.6 | 5.3 | 5.8 |
| BWR (GRAMS LOSS/100 RUBS) | 13.2 | 11.8 | 9.2 | 9.8 |

*includes perfume, colorant, brightener, unreacted AB and about 0.4% of coconut fatty alcohol as unreacted starting material from coconut fatty alkyl sulfate making.

Bar Smear is a measure of the amount of the bar which is readily removed when the bar is allowed to soften upon standing in water for a period of time. Bar wear rate is a measure of the amount of the bar which is worn away by rubbing the bar with a wet cloth.

What is claimed is:

1. A laundry detergent bar comprising:
   (a) from about 10% to about 60% by weight anionic surfactant,
   (b) from about 5% to about 60% by weight detergent builder, and
   (c) from about 0.75% to about 10% by weight fatty alcohol having an alkyl chain containing from 10 to 22 carbon atoms, wherein said anionic surfactant comprises:
   (1) alkylbenzene sulfonate having a linear or branched alkyl chain of from 10 to 22 carbon atoms, and
   (2) alkyl sulfate having an alkyl chain of from 10 to 20 carbon atoms, wherein the weight ratio of (1):(2) is from about 1:9 to about 9:1, and wherein said bar is free of $C_{12}$–$C_{18}$ fatty acid.

2. The laundry bar of claim 1 comprising from about 2% to about 6% said fatty alcohol.

3. The laundry bar of claim 2 comprising from about 3% to about 5% said fatty alcohol.

4. The laundry bar of claim 1 wherein said alkyl chain of said fatty alcohol contains from 12 to 18 carbon atoms.

5. The laundry bar of claim 2 wherein said alkyl chain of said fatty alcohol contains from 16 to 18 carbon atoms.

6. The laundry bar of claim 2 comprising from about 20% to about 40% said anionic surfactant.

7. The laundry bar of claim 2 comprising from about 25% to about 35% said anionic surfactant.

8. The laundry bar of claim 6 wherein said anionic surfactant comprises a weight ratio of (1):(2) from about 1:4 to about 6:1.

9. The laundry bar of claim 8 wherein said anionic surfactant comprises a weight ratio of (1):(2) from about 1:2.0 to about 2.5:1.

10. The laundry bar of claim 6 wherein said detergent builder is selected from the group consisting of water-soluble alkali-metal salts of phosphates, pyrophosphates, orthophosphates, and tripolyphosphates, higher polyphosphates, and mixtures thereof.

11. The laundry bar of claim 10 wherein said detergent builder is selected from the group consisting of sodium tripolyphosphate, sodium pyrophosphate, and mixtures thereof.

12. The laundry bar of claim 11 comprising from about 7% to about 15% said detergent builder.

13. A laundry detergent bar comprising:

(a) about 12% dodecylbenzene sulfonate, (b) about 10% coconut alkyl sulfate, (c) about 10% sodium pyrophosphate, and (d) about 5% $C_{16}$–$C_{18}$ fatty alcohol, wherein the bar is free of $C_{12}$–$C_{18}$ fatty acid.

* * * * *